US010199709B2

(12) United States Patent
Ju

(10) Patent No.: US 10,199,709 B2
(45) Date of Patent: Feb. 5, 2019

(54) MICROWAVE POWER COMBINER

(71) Applicant: Electronics and Telecommunications Research Institute, Daejeon (KR)

(72) Inventor: In Kwon Ju, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 22 days.

(21) Appl. No.: 15/464,627

(22) Filed: Mar. 21, 2017

(65) Prior Publication Data

US 2018/0145395 A1 May 24, 2018

(30) Foreign Application Priority Data

Nov. 21, 2016 (KR) ..... 10-2016-0155289

(51) Int. Cl.
*H01P 5/02* (2006.01)
*H01P 5/18* (2006.01)

(52) U.S. Cl.
CPC ..... *H01P 5/184* (2013.01); *H01P 5/028* (2013.01)

(58) Field of Classification Search
CPC ..... H01P 5/184; H01P 5/028
See application file for complete search history.

(56) References Cited

U.S. PATENT DOCUMENTS

| | | | |
|---|---|---|---|
| 4,074,265 | A | 2/1978 | True |
| 5,937,129 | A | 8/1999 | Jeong et al. |
| 6,347,165 | B1 | 2/2002 | Hyun et al. |
| 6,822,531 | B2 | 11/2004 | Carlson |
| 9,065,163 | B1 | 6/2015 | Wu et al. |

FOREIGN PATENT DOCUMENTS

KR 1558205 B1 * 10/2015 ..... H01P 5/12

* cited by examiner

*Primary Examiner* — Robert J Pascal
*Assistant Examiner* — Kimberly E Glenn
(74) *Attorney, Agent, or Firm* — William Park & Associates Ltd.

(57) ABSTRACT

Provided is a microwave power combiner. A 2-way microwave power combiner includes a first input stage and a second input stage each through which a microwave signal is input; a first output stage through which a sum signal between the microwave signals is output, in response to the microwave signals input through the first input stage and the second input stage having the same phase; and a second output stage through which a difference signal between the microwave signals is output, in response to the microwave signals input through the first input stage and the second input stage having different phases. The first input stage, the second input stage, the first output stage, and the second output stage are connected using a suspended line that includes a conductive line positioned on a dielectric layer provided between air layers.

12 Claims, 4 Drawing Sheets

MICROWAVE POWER COMBINER

CROSS-REFERENCE TO RELATED APPLICATION(S)

This application claims the priority benefit of Korean Patent Application No. 10-2016-0155289 filed on Nov. 21, 2016 in the Korean Intellectual Property Office, the disclosure of which is incorporated herein by reference for all purposes.

BACKGROUND

1. Field

At least one example embodiment relates to a microwave power combiner.

2. Description of Related Art

Power amplifiers configured to transmit a high power are required for transmitters of various types of wireless systems, such as a personal mobile communication system, a satellite communication system, and the like. A frequency band and an output power used by various types of communication systems including a $5^{th}$ generation mobile communication system are on the gradual increase. However, according to an increase in the frequency band, an output power for each power amplifier device may decrease. Accordingly, there is a need for a microwave power combiner capable of combining powers of power amplifiers to configure a relatively high output power at a high frequency, that is, microwave.

Among microwave power combiners according to the related art, a planar Wilkinson 2-way power combiner combines in-phase signals and outputs the same to an output stage in response to the in-phase signal input to an input stage, and attenuates a difference signal to isolation resistor in response to a phase difference being present in the input signal. Here, the isolation resistor needs to be a power rating of half or more of power input to the input stage. Thus, a power rating of a Wilkinson-typed power combiner is determined based on the power rating of the isolation resistor.

However, a size of a circuit needs to be reduced according to an increase in a signal frequency. There is no except even for the isolation resistor. A power rating of planar resistor is in proportion to an area of the planar resistor. Accordingly, the higher frequency the resistor is for, the further the power rating decreases.

The higher a signal frequency, the further the power rating decreases. Thus, the Wilkinson-typed power combiner may not combine a high power.

Accordingly, there is a need for a microwave power combiner having a high operational frequency, a high isolation, a high power rating, and a high combination efficiency compared to a conventional microwave power combiner.

SUMMARY

At least one example embodiment provides a microwave power combiner having a high operational frequency, a high isolation, a high power rating, and a high combination efficiency compared to a conventional microwave power combiner.

According to an aspect of at least one example embodiment, there is provided a 2-way microwave power combiner including a first input stage and a second input stage each through which a microwave signal is input; a first output stage through which a sum signal of the microwave signals is output, in response to the microwave signals input through the first input stage and the second input stage having the same phase; and a second output stage through which a difference signal between the microwave signals is output, in response to the microwave signals input through the first input stage and the second input stage having different phases. The first input stage, the second input stage, the first output stage, and the second output stage are connected using a suspended line that includes a conductive line positioned on a dielectric layer provided between air layers, and the suspended line includes a broadband transition using a matching circuit in a connection section between the suspended line and a microstrip line.

A characteristic impedance of the suspended line of the 2-way microwave power may be determined based on a width of the conductive line, a thickness of the dielectric layer, a dielectric constant of the dielectric layer, a thickness of the air layer, a dielectric constant of the air layer, a width of the dielectric layer, and a width of the air layer.

The second output stage of the 2-way microwave power may include two terminals configured to combine with two microwave terminators, respectively.

The microwave terminator of the 2-way microwave power may include the microstrip line connected to the suspended line of the second output stage; a thin-film resistor positioned on the dielectric layer of the microstrip line and provided in a semi-circular shape; and the broadband transition provided between the microstrip line and the suspended line of the second output stage, and using the matching circuit that includes a serial inductance and a parallel capacitance.

The connection section between the suspended line of the 2-way microwave power and the microstrip line may include the broadband transition using the matching circuit that includes a serial inductance and a parallel capacitance and a via-hole connected to a ground on the microstrip line.

According to an aspect of at least one example embodiment, there is provided a 4-way microwave power combiner to receive a first microwave signal, a second microwave signal, a third microwave signal, and a fourth microwave signal through a first input stage, a second input stage, a third input stage, and a fourth input stage, respectively, the 4-way microwave power combiner including a 2-way first microwave power combiner configured to receive the first microwave signal and the second microwave signal, to output a first sum signal of the first microwave signal and the second microwave signal in response to the first microwave signal and the second microwave signal having the same phase, and to output a difference signal between the first microwave signal and the second microwave signal in response to the first microwave signal and the second microwave signal having different phases; a 2-way second microwave power combiner configured to receive the third microwave signal and the fourth microwave signal, to output a second sum signal of the third microwave signal and the fourth microwave signal in response to the third microwave signal and the fourth microwave signal having the same phase, and to output a difference signal between the third microwave signal and the fourth microwave signal in response to the third microwave signal and the fourth microwave signal having different phases; and a 2-way third microwave power combiner configured to receive the first sum signal and the second sum signal, to output a third sum signal of the first sum signal and the second sum signal in response to the first sum signal and the second sum signal having the same phase, and to output a difference signal between the first sum signal and the second sum signal in response to the first sum signal and the second sum signal having different phases.

In the 2-way first microwave power combiner, an input stage configured to receive the first microwave signal and the second microwave signal, an output stage configured to output the first sum signal, and an output stage configured to output the difference signal between the first microwave signal and the second microwave signal may be connected using a suspended line that includes a conductive line positioned on a dielectric layer provided between air layers.

In the 2-way second microwave power combiner, an input stage configured to receive the third microwave signal and the fourth microwave signal, an output stage configured to output the second sum signal, and an output stage configured to output the difference signal between the third microwave signal and the fourth microwave signal may be connected using a suspended line that includes a conductive line positioned on a dielectric layer provided between air layers.

In the 2-way third microwave power combiner, an input stage configured to receive the first sum signal and the second sum signal, an output stage configured to output the third sum signal, and an output stage configured to output the difference signal between the first sum signal and the second sum signal may be connected using a suspended line that includes a conductive line positioned on a dielectric layer provided between air layers.

A characteristic impedance of the suspended line of the 4-way microwave power combiner may be determined based on a width of the conductive line, a thickness of the dielectric layer, a dielectric constant of the dielectric layer, a thickness of the air layer, a dielectric constant of the air layer, a width of the dielectric layer, and a width of the air layer.

An output stage of the 4-way microwave power combiner configured to output one of the difference signal between the first microwave signal and the second microwave signal, the difference signal between the third microwave signal and the fourth microwave signal, and the difference signal between the first sum signal and the second sum signal may include two terminals configured to combine with two microwave terminators, respectively.

The microwave terminator may include a microstrip line connected to a suspended line of the output stage configured to output one of the difference signals; a thin-film resistor positioned on a dielectric layer of the microstrip line and provided in a semi-circular shape; and a broadband transition provided between the microstrip line and the suspended line of the output stage, and using the matching circuit that includes a serial inductance and a parallel capacitance.

According to some example embodiments, since a suspended line that uses air having a significantly small dielectric loss as a primary medium is employed as an internal transmission line of a microwave power combiner, it is possible to reduce an insertion loss and to enhance a combination efficiency.

Also, according to some example embodiments, a microwave terminator may have a high power rating due to a wide area and may show a high and wide operational frequency band due to a semicircular shape. Accordingly, a microwave power combiner having a high operational frequency, a high isolation, a high power rating, and a high combination efficiency may be configured.

Also, according to some example embodiments, a microwave power combiner may be used for combining powers of microwave signals at transceivers of various wireless systems, for example, a personal portable communication system, a satellite communication system, and the like.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
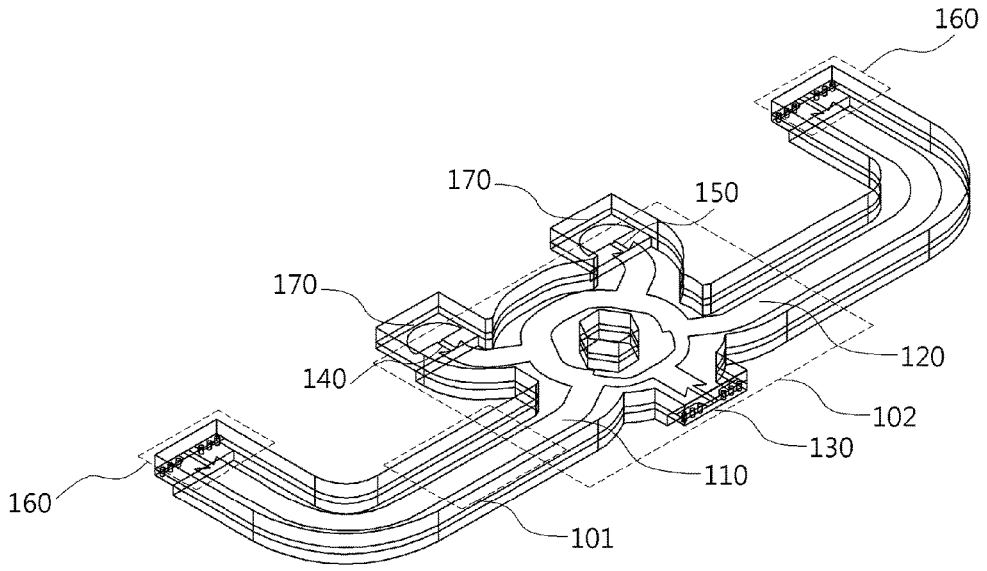
FIG. 1 is a perspective view illustrating an example of a 2-way microwave power combiner according to an example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

FIG. 1 is a perspective view illustrating an example of a 2-way microwave power combiner according to an example embodiment.

Referring to FIG. 1, the 2-way microwave power combiner may include a power combiner 102, a broadband transition 160 using a matching circuit, and a microwave terminator 170.

Here, microwave signals may be input to a first input stage 110 and a second input stage 120 through the broadband transition 160 to which a microstrip line and a suspended line 101 are connected.

If the microwave signals input through the first input stage 110 and the second input stage 120 have the same phase, a sum signal of the microwave signals may be output through a first output stage 130 of the power combiner 102. Here, the sum signal of the microwave signals may be a signal generated by combining the microwave signals input through the first input stage 110 and the second input stage 120.

Also, if the microwave signals input through the first input stage 110 and the second input stage 120 have different phases, a difference signal between the microwave signals may be output through a second output stage of the power combiner 102. Here, the difference signal between the microwave signals may be a signal generated based on a difference between the microwave signals input through the first input stage 110 and the second input stage 120.

Referring to FIG. 1, the second output stage may include a first terminal 140 and a second terminal 150 configured to combine with two microwave terminators 170, respectively.

The broadband transition 160 may be a connection section between an external microstrip line and the suspended line 101 inside the 2-way microwave power combiner. A structure of the broadband transition 160 will be described with reference to FIG. 4.

The microwave terminators 170 combine with the first terminal 140 and the second terminal 150 of the second output stage, respectively, and may attenuate a difference signal that is output from a combined terminal. A structure of the microwave terminator 170 will be further described with reference to FIG. 5.

A 2-way microwave power combiner according to example embodiments may employ a suspended line using air having a significantly small dielectric loss as a primary medium as an internal transmission line of the microwave power combiner and thus, may have a small insertion loss and a high combination efficiency compared to a conventional microwave power combiner. Also, according to example embodiments, the microwave power combiner may use a microwave terminator having a high and wide microwave matching characteristic due to a semicircular shape and have a high power rating due to a wide area, and thus may have a high operational frequency, a high isolation, and a high power rating compared to the conventional microwave power combiner.

The 2-way microwave power combiner according to example embodiments may be used for combining powers of microwave signals at transceivers of various wireless systems, for example, a personal portable communication system, a satellite communication system, and the like.

Figure 2:
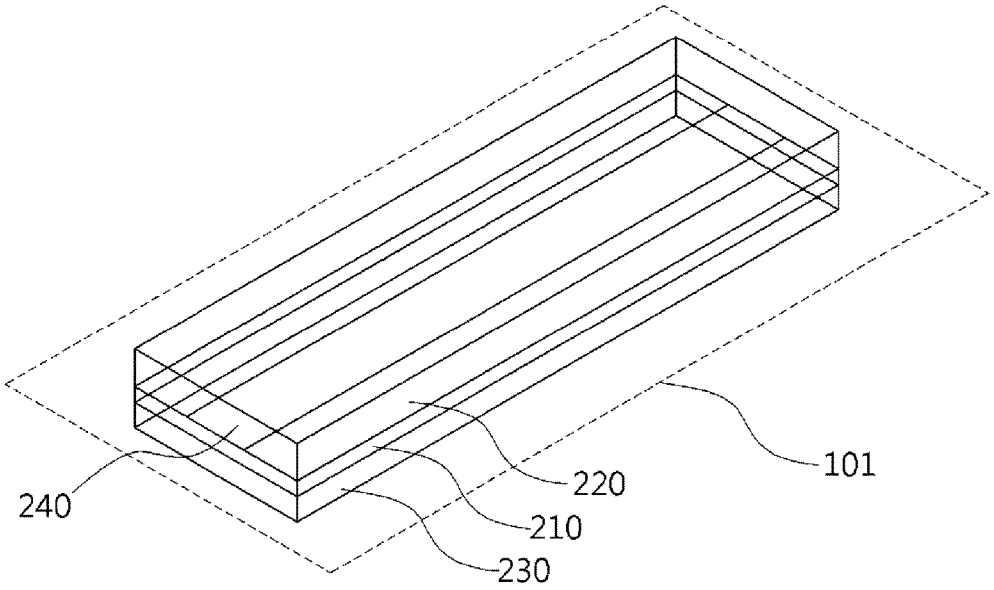
FIG. 2 is a perspective view illustrating an example of a suspended line of a microwave power combiner according to an example embodiment.

FIG. 2 is a perspective view illustrating an example of a suspended line of a microwave power combiner according to an example embodiment.

Referring to FIG. 2, the suspended line 101 used as the internal transmission line of the 2-way microwave power combiner may include a dielectric layer 210 formed using a dielectric substance, an air layer 220 disposed on the dielectric layer 210, and an air layer 230 disposed below the dielectric layer 210, and a conductive line 240 positioned on the dielectric layer 210.

The air layers 220 and 230 formed on a top surface and a bottom surface of the suspended line 101 may be formed by conductor sides that encompass the suspended line 101. Here, the air layer 220 may be formed by separating a top surface of the dielectric layer 210 from a top surface of the conductor encompassing the suspended line 101. The air layer 230 may be formed by separating a bottom surface of the dielectric layer 210 from a bottom surface of the conductor encompassing the suspended line 101.

Also, the suspended line 101 includes the conductive line 240 having a width greater than that of a conductive line included in a microstrip line used for a conventional microwave power combiner. Accordingly, a conductive loss may be reduced.

A characteristic impedance of the suspended line 101 may be determined based on the width of the conductive line 240, a thickness of the dielectric layer 210, a dielectric constant of the dielectric layer 210, a thickness of the air layer 220, 230, a dielectric constant of the air layer 220, 230, a width of the dielectric layer 210, and a width of the air layer 220, 230.

The higher a signal frequency, the further an insertion loss of the transmission line may increase. The microstrip line used for the conventional microwave power combiner performs transmission by using a dielectric layer formed using a dielectric substance as a primary medium and thus, has a relatively great insertion loss due to a dielectric loss.

Referring to FIG. 2, in the suspended line 101, an area of the air layers 220 and 230 is wider than that of the dielectric layer 210. Thus, an area in which the air is used as a medium may be wider than an area in which a dielectric substance is used as a medium. Since the suspended line 101 uses the air having a small dielectric loss as a primary medium, the insertion loss of the suspended line 101 may be less than that of the microstrip line.

Figure 3:
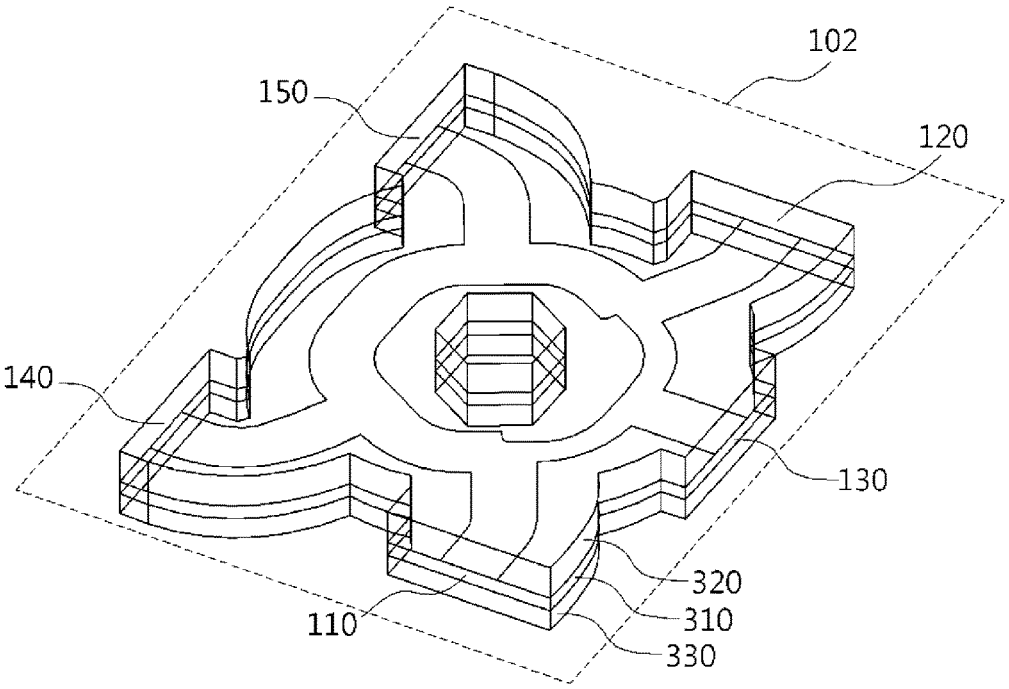
FIG. 3 is a perspective view illustrating an example of a power combiner of a microwave power combiner according to an example embodiment.

FIG. 3 is a perspective view illustrating an example of a power combiner of a microwave power combiner according to an example embodiment.

Referring to FIG. 3, the power combiner 102 may include the first input stage 110, the second input stage 120, the first output stage 130, the first terminal 140, and the second terminal 150. Here, the first input stage 110 and the second input stage 120 may be terminals through which microwave signals are input.

If microwave signals input through the first input stage 110 and the second input stage 120 have the same phase, the first output stage 130 may be a terminal through which a sum signal of the microwave signals is output.

If the microwave signals input through the first input stage 110 and the second input stage 120 have different phases, the second output stage may be a terminal through which a difference signal between the microwave signals is output. Here, the second output stage includes the first terminal 140 and the second terminal 150. Microwave terminators configured to attenuate the difference signal combine with the first terminal 140 and the second terminal 150, respectively. Accordingly, the second output stage may have a power rating corresponding to two folds of that of the conventional power combiner that includes a single microwave terminator.

The first input stage 110, the second input stage 120, the first output stage 130, the first terminal 140, and the second terminal 150 may be connected using a suspended line. Also, referring to FIG. 3, the suspended line configured to connect the first input stage 110, the second input stage 120, the first output stage 130, the first terminal 140, and the second terminal 150 may include a dielectric layer 310 formed using a dielectric substance, an air layer 320 disposed on the dielectric layer 310, an air layer 330 disposed below the dielectric layer 310, and a conductive line positioned on the dielectric layer 310.

The suspended line of FIG. 3 that connects the first input stage 110, the second input stage 120, the first output stage 130, the first terminal 140, and the second terminal 150 is configured to be the same as the suspended line 101 of FIG. 2. Thus, a further description related to the dielectric layer 310, the air layer 320, the air layer 330, and the conductive line is omitted here.

Figure 4A:
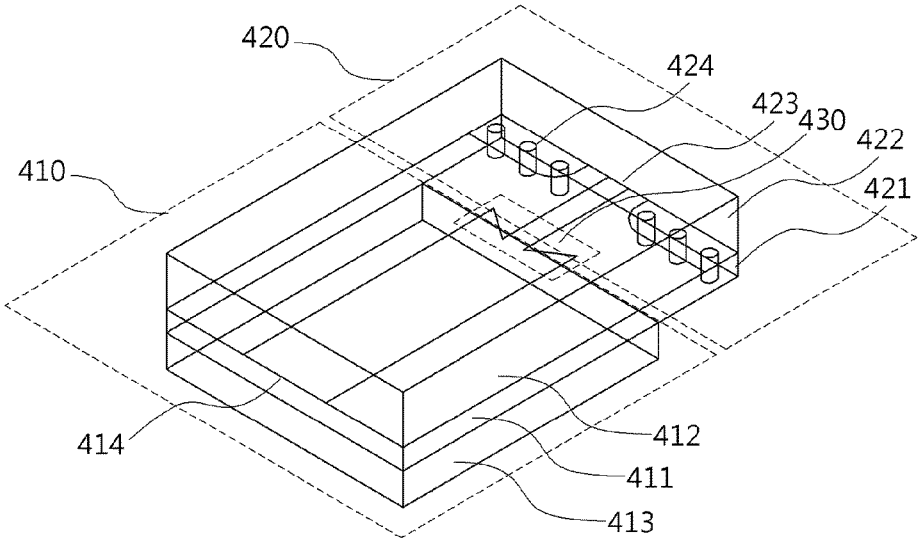
FIGS. 4A and 4B illustrate an example of a transition between a suspended line and a microstrip line according to an example embodiment.
Figure 4B:
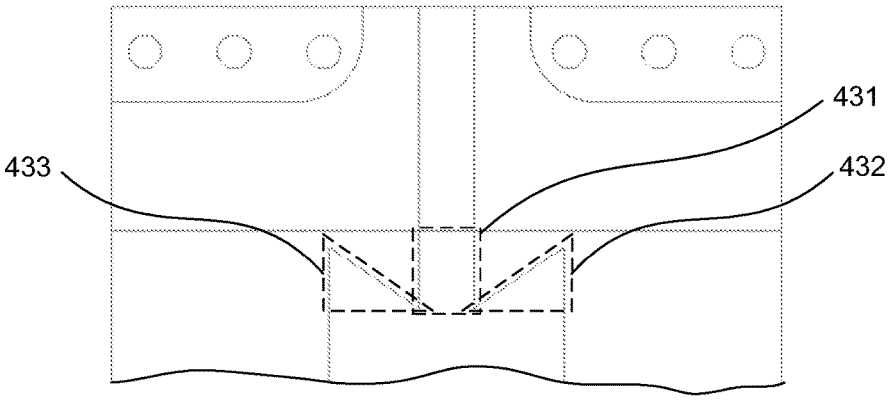

FIGS. 4A and 4B illustrate an example of a transition between a suspended line and a microstrip line according to an example embodiment.

While a transmission line used for a conventional microwave power combiner is a microstrip line, a transmission line used for a microwave power combiner according to an example embodiment is a suspended line. Accordingly, the microwave power combiner according to the example embodiment may require a broadband transition using a matching circuit to connect the suspended line and the microstrip line.

A type of the transmission line may be switched as a frequency of a signal becomes high. Also, a signal reflection may increase in a discontinuous section, for example, a connecting portion, in which the transmission line is discontinuous. It may lead to increasing an insertion loss. Accordingly, the transition having a low loss characteristic needs to be configured by matching the discontinuity.

Referring to FIG. 4, the broadband transition 160 according to an example embodiment may be configured as a transition 430 between a suspended line 410 and a microstrip line 420.

The suspended line 410 may include a dielectric layer 411 formed using a dielectric substance, an air layer 412 disposed on the dielectric layer 411, an air layer 413 disposed below the dielectric layer 411, and a conductive line 414 positioned on the dielectric layer 411.

The microstrip line 420 may include a dielectric layer 421 formed using a dielectric substance, an air layer 422 disposed on the dielectric layer 421, and a conductive line 423 positioned on the dielectric layer 421. Via-holes 424 connected to a ground may be provided to the microstrip line 420.

The dielectric layer 411 of the suspended line 410 and the dielectric layer 421 of the microstrip line 420 may be the same dielectric layer. The air layer 412 disposed on the suspended line 410 and the air layer 422 disposed on the microstrip line 420 may be the same air layer.

Here, the transition 430 may be positioned between the conductive line 414 and the conductive line 423. Referring to FIG. 4B, for example, the transition 430 may include a serial inductance 431 and parallel capacitances 432 and 433. The transition 430 may reduce a signal reflection and an insertion loss through matching of discontinuity using a wideband, thereby achieving a wideband low loss characteristic.

Figure 5:
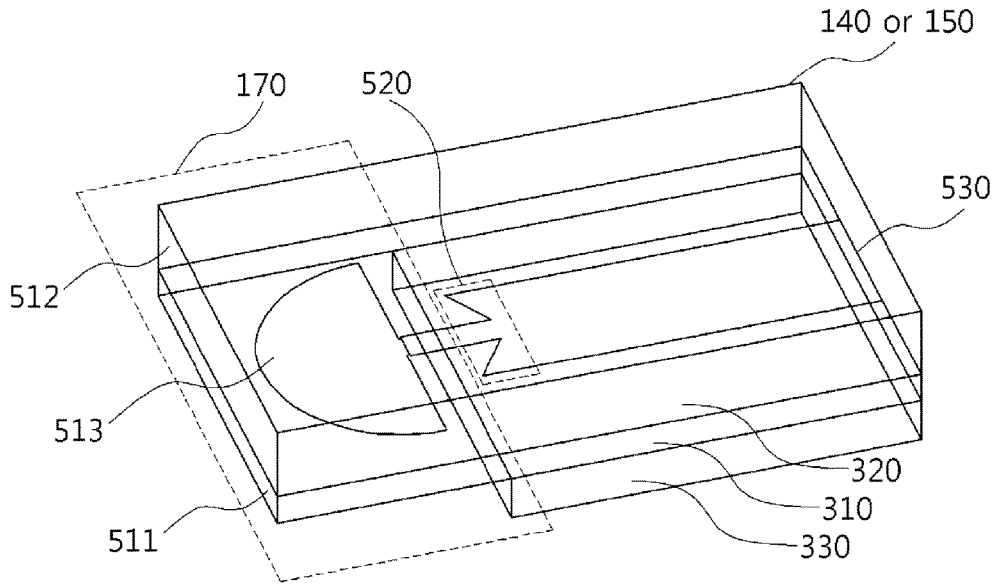
FIG. 5 is a perspective view illustrating an example of a microwave terminator according to an example embodiment.

FIG. 5 is a perspective view illustrating an example of a microwave terminator according to an example embodiment.

Referring to FIG. 5, the microwave terminator 170 may include a microstrip line, a thin film resistor 513, and a transition 520.

The microwave terminator 170 may combine with the first terminal 140 or the second terminal 150. The first terminal 140 or the second terminal 150 may be connected to a suspended line of the power combiner 102. Accordingly, an input stage of the microwave terminator 170 may include a dielectric layer 310 formed using a dielectric substance corresponding to the suspended line of the power combiner 102, an air layer 320 disposed on the dielectric layer 310, an air layer 330 disposed below the dielectric layer 310, and a conductive line 530 positioned on the dielectric layer 310.

The microstrip line of the microwave terminator 170 may be connected to the suspended line of the first terminal 140 or the second terminal 150, and may include a dielectric layer 511 formed using a dielectric substance and an air layer 512 disposed on the dielectric layer 511.

Referring to FIG. 5, the thin film resistor 513 may be positioned on the dielectric layer 511, and may have a high and wide microwave matching characteristic due to a semicircular shape and may secure a high power rating due to a wide area.

Similar to the example of FIG. 4, the transition 520 may include a serial inductance and a parallel capacitance.

Figure 6:
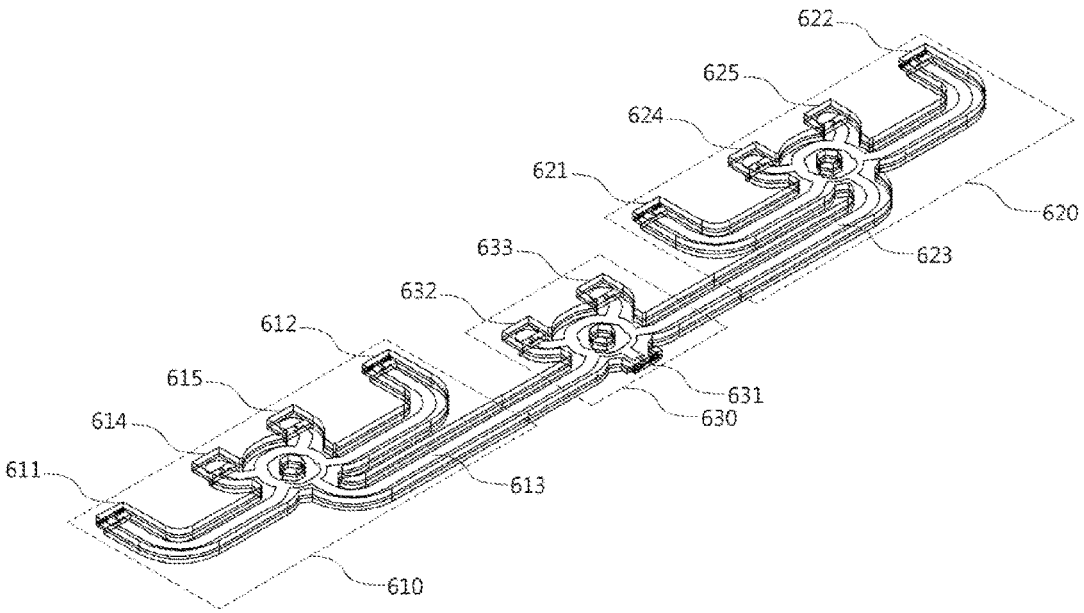
FIG. 6 is a perspective view illustrating an example of a 4-way microwave power combiner according to an example embodiment.

FIG. 6 is a perspective view illustrating an example of a 4-way microwave power combiner according to an example embodiment.

Referring to FIG. 6, the 4-way microwave power combiner is configured to receive a first microwave signal, a second microwave signal, a third microwave signal, and a fourth microwave signal through a first input stage 611, a second input stage 612, a third input stage 621, and a fourth input stage 622, respectively, and may include three 2-way microwave power combiners.

Among the three 2-way microwave power combiners included in the 4-way microwave power combiner, a 2-way first microwave power combiner 610 may receive the first microwave signal through the first input stage 611 and may receive the second microwave signal through the second input stage 612.

If the first microwave signal and the second microwave signal have the same phase, the 2-way first microwave power combiner 610 may output a first sum signal of the first microwave signal and the second microwave signal through a first output stage 613.

Also, if the first microwave signal and the second microwave signal have different phases, the 2-way first microwave power combiner 610 may output a difference signal between the first microwave signal and the second microwave signal to a first terminal 614 and a second terminal 615. Here, the difference signal between the first microwave signal and the second microwave signal may be attenuated through microwave terminators connected to the first terminal 614 and the second terminal 615, respectively.

Among the three 2-way microwave power combiners included in the 4-way microwave power combiner, a 2-way second microwave power combiner 620 may receive a third microwave signal through the third input stage 621 and may receive a fourth microwave signal through the fourth input stage 622.

If the third microwave signal and the fourth microwave signal have the same phase, the 2-way second microwave power combiner 620 may output a second sum signal of the third microwave signal and the fourth microwave signal through a second output stage 623.

Also, if the third microwave signal and the fourth microwave signal have different phases, the 2-way second microwave power combiner 620 may output a difference signal between the third microwave signal and the fourth microwave signal to a third terminal 624 and a fourth terminal 625. Here, the difference signal between the third microwave signal and the fourth microwave signal may be attenuated by microwave terminators connected to the third terminal 624 and the fourth terminal 625, respectively.

Among the three 2-way microwave power combiners included in the 4-way microwave power combiner, a 2-way third microwave power combiner 630 may receive the first sum signal through an input stage connected to the first output stage 613 and may receive the second sum signal through an input stage connected to the second output stage 623.

If the first sum signal and the second sum signal have the same phase, the 2-way third microwave power combiner 630 may output a third sum signal of the first sum signal and the second sum signal through a third output stage 631.

Also, if the first sum signal and the second sum signal have different phases, the 2-way third microwave power combiner 630 may output a difference signal between the first sum signal and the second sum signal to a fifth terminal 632 and a sixth terminal 633. A difference signal between the first sum signal and the second sum signal may be attenuated through microwave terminators connected to the fifth terminal 632 and the sixth terminal 633, respectively.

Each of the 2-way first microwave power combiner 610, the 2-way second microwave power combiner 620, and the 2-way third microwave power combiner 630 may be configured to be the same as the 2-way microwave power combiner of FIG. 1 and thus, a further description related thereto is omitted.

A microwave power combiner according to example embodiments employs a suspended line that uses air having a significantly small dielectric loss as a primary medium as an internal transmission line of a microwave power combiner, and thus may have a small insertion loss and high combination efficiency compared to a conventional microwave power combiner. Also, the microwave power combiner may use a microwave terminator having a high and wide microwave matching characteristic due to a semicircular shape and have a high power rating due to a wide area and thus may have a high operational frequency, a high isolation, and a high power rating compared to the conventional microwave power combiner.

Also, a 4-way microwave power combiner according to example embodiments may be used for combining powers of microwave signals at transceivers of various wireless systems, for example, a personal portable communication system, a satellite communication system, and the like.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A 2-way microwave power combiner comprising:

a first input stage and a second input stage each through which a microwave signal is input;

a first output stage through which a sum signal between the microwave signals is output, in response to the microwave signals input through the first input stage and the second input stage having a same phase; and a second output stage through which a difference signal between the microwave signals is output, in response to the microwave signals input through the first input stage and the second input stage having different phases, wherein the first input stage, the second input stage, the first output stage, and the second output stage are connected using a suspended line that includes a conductive line positioned on a dielectric layer provided between air layers, and wherein the suspended line includes a broadband transition using a matching circuit in a connection section between the suspended line and a microstrip line.

2. The 2-way microwave power combiner of claim 1, wherein a characteristic impedance of the suspended line is determined based on a width of the conductive line, a thickness of the dielectric layer, a dielectric constant of the dielectric layer, a thickness of the air layer, a dielectric constant of the air layer, a width of the dielectric layer, and a width of the air layer.

3. The 2-way microwave power combiner of claim 1, wherein the second output stage comprises two terminals configured to combine with two microwave terminators, respectively.

4. The 2-way microwave power combiner of claim 3, wherein the microwave terminator comprises:

the microstrip line connected to the suspended line of the second output stage;

a thin-film resistor positioned on the dielectric layer of the microstrip line and provided in a semi-circular shape; and the broadband transition provided between the microstrip line and the suspended line of the second output stage, and using the matching circuit that includes a serial inductance and a parallel capacitance.

5. The 2-way microwave power combiner of claim 1, wherein the connection section between the suspended line and the microstrip line comprises the broadband transition using the matching circuit that includes a serial inductance and a parallel capacitance, and a via-hole connected to a ground on the microstrip line.

6. A 4-way microwave power combiner to receive a first microwave signal, a second microwave signal, a third microwave signal, and a fourth microwave signal through a first input stage, a second input stage, a third input stage, and a fourth input stage, respectively, the 4-way microwave power combiner comprising:

a 2-way first microwave power combiner configured to receive the first microwave signal and the second microwave signal, to output a first sum signal of the first microwave signal and the second microwave signal in response to the first microwave signal and the second microwave signal having a same phase, and to output a difference signal between the first microwave signal and the second microwave signal in response to the first microwave signal and the second microwave signal having different phases;

a 2-way second microwave power combiner configured to receive the third microwave signal and the fourth microwave signal, to output a second sum signal of the third microwave signal and the fourth microwave signal in response to the third microwave signal and the fourth microwave signal having the same phase, and to output a difference signal between the third microwave signal and the fourth microwave signal in response to the third microwave signal and the fourth microwave signal having different phases; and a 2-way third microwave power combiner configured to receive the first sum signal and the second sum signal, to output a third sum signal of the first sum signal and the second sum signal in response to the first sum signal and the second sum signal having the same phase, and to output a difference signal between the first sum signal and the second sum signal in response to the first sum signal and the second sum signal having different phases.

7. The 4-way microwave power combiner of claim 6, wherein, in the 2-way first microwave power combiner, the first input stage configured to receive the first microwave signal, the second input stage configured to receive the second microwave signal, an output stage configured to output the first sum signal, and an output stage configured to output the difference signal between the first microwave signal and the second microwave signal are connected using a suspended line that includes a conductive line positioned on a dielectric layer provided between air layers.

8. The 4-way microwave power combiner of claim 6, wherein, in the 2-way second microwave power combiner, the third input stage configured to receive the third microwave signal, the fourth input stage configured to receive the fourth microwave signal, an output stage configured to output the second sum signal, and an output stage configured to output the difference signal between the third microwave signal and the fourth microwave signal are connected using a suspended line that includes a conductive line positioned on a dielectric layer provided between air layers.

9. The 4-way microwave power combiner of claim 6, wherein, in the 2-way third microwave power combiner, an input terminal connected to the first output terminal to receive the first sum signal, an input terminal connected to the second output terminal to receive the second sum signal, an output stage configured to output the third sum signal, and an output stage configured to output the difference signal between the first sum signal and the second sum signal are connected using a suspended line that includes a conductive line positioned on a dielectric layer provided between air layers.

10. The 4-way microwave power combiner of claim 7, wherein a characteristic impedance of the suspended line is determined based on a width of the conductive line, a thickness of the dielectric layer, a dielectric constant of the dielectric layer, a thickness of the air layer, a dielectric constant of the air layer, a width of the dielectric layer, and a width of the air layer.

11. The 4-way microwave power combiner of claim 6, wherein an output stage configured to output one of the difference signal between the first microwave signal and the second microwave signal, the difference signal between the third microwave signal and the fourth microwave signal, and the difference signal between the first sum signal and the second sum signal comprises two terminals configured to combine with two microwave terminators, respectively.

12. The 4-way microwave power combiner of claim 11, wherein the microwave terminator comprises:

a microstrip line connected to a suspended line of the output stage configured to output one of the difference signals;

a thin-film resistor positioned on a dielectric layer of the microstrip line and provided in a semi-circular shape; and a broadband transition provided between the microstrip line and the suspended line of the output stage, and using a matching circuit that includes a serial inductance and a parallel capacitance, wherein the matching circuit is provided between the microstrip line and the suspended line of the output stage.

* * * * *